US007674501B2

(12) United States Patent
Raksha et al.

(10) Patent No.: US 7,674,501 B2
(45) Date of Patent: Mar. 9, 2010

(54) TWO-STEP METHOD OF COATING AN ARTICLE FOR SECURITY PRINTING BY APPLICATION OF ELECTRIC OR MAGNETIC FIELD

(75) Inventors: Vladimir P. Raksha, Santa Rosa, CA (US); Paul G. Coombs, Santa Rosa, CA (US); Neil Teitelbaum, Ottawa (CA); Charles T. Markantes, Santa Rosa, CA (US); Alberto Argoitia, Santa Rosa, CA (US)

(73) Assignee: JDS Uniphase Corporation, Milpitas, CA (US)

( * ) Notice: Subject to any disclaimer, the term of this patent is extended or adjusted under 35 U.S.C. 154(b) by 692 days.

(21) Appl. No.: 11/415,027

(22) Filed: May 1, 2006

(65) Prior Publication Data

US 2006/0194040 A1 Aug. 31, 2006

Related U.S. Application Data

(60) Continuation-in-part of application No. 11/028,819, filed on Jan. 4, 2005, now Pat. No. 7,300,695, which is a division of application No. 10/243,111, filed on Sep. 13, 2002, now Pat. No. 6,902,807.

(60) Provisional application No. 60/700,994, filed on Jul. 20, 2005.

(51) Int. Cl.

| | |
|---|---|
| ***B05D 1/06*** | (2006.01) |
| ***B05D 1/36*** | (2006.01) |
| ***B05D 1/38*** | (2006.01) |
| ***B05D 3/14*** | (2006.01) |

(52) U.S. Cl. ..... 427/472; 427/202; 427/203; 427/258; 427/261; 427/372.2; 427/402; 427/466; 427/469; 427/474

(58) Field of Classification Search ..... 427/202, 427/203, 258, 261, 372.2, 402, 466, 469, 427/472, 474

See application file for complete search history.

(56) References Cited

U.S. PATENT DOCUMENTS

| | | | | |
|---|---|---|---|---|
| 2,570,856 | A | 10/1951 | Pratt et al. | 41/32 |
| 3,011,383 | A | 12/1961 | Sylvester et al. | 359/584 |

(Continued)

FOREIGN PATENT DOCUMENTS

| | | |
|---|---|---|
| AU | 488652 | 11/1977 |

(Continued)

OTHER PUBLICATIONS

"Optical Thin-Film Security Devices", J.A. Dobrowolski, Optical Security Document, Rudolf Van Renesse, Artech House, 1998, pp. 289-328.

(Continued)

*Primary Examiner*—H. (Holly) T Le
(74) *Attorney, Agent, or Firm*—Matthew A. Pequignot; Pequignot + Myers LLC

(57) ABSTRACT

A two-step method of making of a security printed image is disclosed and includes coating of the surface of a substrate with a predetermined image shape with an ink containing flaked magnetic pigment in a predetermined concentration, exposing a wet printed image to a magnetic field to align magnetic particles in a predetermined manner, allowing the ink to cure, and coating the substrate with a second printed image on the top of the first image. The second printed image with the same or different image shape is printed with another ink containing clear or dyed ink vehicle mixed with flaked magnetic pigment in a low concentration, exposed to the magnetic field of the same or different configuration as the first printed image and cured until the ink is dry.

9 Claims, 5 Drawing Sheets

U.S. PATENT DOCUMENTS

| | | | | |
|---|---|---|---|---|
| 3,123,490 | A | 3/1964 | Bolomey et al. | 106/291 |
| 3,338,730 | A | 8/1967 | Slade et al. | 428/142 |
| 3,610,721 | A | 10/1971 | Abramson et al. | 350/3.5 |
| 3,627,580 | A | 12/1971 | Krall | 117/238 |
| 3,633,720 | A | 1/1972 | Tyler | 400/105 |
| 3,640,009 | A | 2/1972 | Komiyama | 283/88 |
| 3,676,273 | A | 7/1972 | Graves | 161/3 |
| 3,790,407 | A | 2/1974 | Merten et al. | 428/148 |
| 3,791,864 | A | 2/1974 | Steingroever | 117/238 |
| 3,845,499 | A | 10/1974 | Ballinger | 346/74.3 |
| 3,853,676 | A | 12/1974 | Graves et al. | |
| 3,873,975 | A | 3/1975 | Miklos et al. | 360/25 |
| 4,011,009 | A | 3/1977 | Lama et al. | 359/571 |
| 4,054,922 | A | 10/1977 | Fichter | 346/74.3 |
| 4,066,280 | A | 1/1978 | LaCapria | 283/91 |
| 4,099,838 | A | 7/1978 | Cook et al. | 359/537 |
| 4,126,373 | A | 11/1978 | Moraw | 359/2 |
| 4,155,627 | A | 5/1979 | Gale et al. | 359/568 |
| 4,168,983 | A | 9/1979 | Vittands et al. | 106/14.12 |
| 4,197,563 | A | 4/1980 | Michaud | 346/74.3 |
| 4,244,998 | A | 1/1981 | Smith | |
| 4,271,782 | A | 6/1981 | Bate et al. | 118/623 |
| 4,310,180 | A | 1/1982 | Mowry, Jr. et al. | 283/67 |
| 4,310,584 | A | 1/1982 | Cooper et al. | 428/212 |
| 4,398,798 | A | 8/1983 | Krawczak et al. | 359/573 |
| 4,434,010 | A | 2/1984 | Ash | 106/415 |
| 4,543,551 | A | 9/1985 | Peterson | 335/284 |
| 4,668,597 | A | 5/1987 | Merchant | 430/22 |
| 4,705,300 | A | 11/1987 | Berning et al. | 283/91 |
| 4,705,356 | A | 11/1987 | Berning et al. | 350/166 |
| 4,721,217 | A | 1/1988 | Phillips et al. | 215/230 |
| 4,756,771 | A | 7/1988 | Brodalla et al. | 148/244 |
| 4,779,898 | A | 10/1988 | Berning et al. | 283/58 |
| 4,788,116 | A | 11/1988 | Hochberg | 430/21 |
| 4,838,648 | A | 6/1989 | Phillips et al. | 359/585 |
| 4,867,793 | A | 9/1989 | Franz et al. | 106/415 |
| 4,925,215 | A | 5/1990 | Klaiber | 283/82 |
| 4,930,866 | A | 6/1990 | Berning et al. | 359/589 |
| 4,931,309 | A | 6/1990 | Komatsu et al. | 427/599 |
| 5,002,312 | A | 3/1991 | Phillips et al. | 283/72 |
| 5,009,486 | A | 4/1991 | Dobrowolski et al. | 359/580 |
| 5,037,101 | A | 8/1991 | McNulty | 273/139 |
| 5,059,245 | A | 10/1991 | Phillips et al. | 106/31.65 |
| 5,079,058 | A | 1/1992 | Tomiyama | |
| 5,079,085 | A | 1/1992 | Hashimoto et al. | 428/327 |
| 5,084,351 | A | 1/1992 | Phillips et al. | 428/411.1 |
| 5,106,125 | A | 4/1992 | Antes | 283/91 |
| 5,128,779 | A | 7/1992 | Mallik | 359/2 |
| 5,135,812 | A | 8/1992 | Phillips et al. | 428/403 |
| 5,142,383 | A | 8/1992 | Mallik | 359/2 |
| 5,171,363 | A | 12/1992 | Phillips et al. | 106/31.65 |
| 5,177,344 | A | 1/1993 | Pease | 235/449 |
| 5,186,787 | A | 2/1993 | Phillips et al. | 216/36 |
| 5,192,611 | A | 3/1993 | Tomiyama et al. | 428/354 |
| 5,214,530 | A | 5/1993 | Coombs et al. | 359/359 |
| 5,215,576 | A | 6/1993 | Carrick | 524/425 |
| 5,223,360 | A | 6/1993 | Prengel et al. | 430/39 |
| 5,254,390 | A | 10/1993 | Lu | 428/156 |
| 5,278,590 | A | 1/1994 | Phillips et al. | 359/589 |
| 5,279,657 | A | 1/1994 | Phillips et al. | 106/31.65 |
| 5,339,737 | A | 8/1994 | Lewis et al. | 101/454 |
| 5,364,467 | A | 11/1994 | Schmid et al. | 106/404 |
| 5,364,689 | A | 11/1994 | Kashiwagi et al. | 428/195.1 |
| 5,368,898 | A | 11/1994 | Akedo | 427/510 |
| 5,411,296 | A | 5/1995 | Mallik | 283/86 |
| 5,424,119 | A | 6/1995 | Phillips et al. | 428/328 |
| 5,437,931 | A | 8/1995 | Tsai et al. | 428/446 |
| 5,447,335 | A | 9/1995 | Haslop | 283/91 |
| 5,464,710 | A | 11/1995 | Yang | 430/1 |
| 5,474,814 | A | 12/1995 | Komatsu et al. | 427/549 |
| 5,549,774 | A | 8/1996 | Miekka et al. | 156/209 |
| 5,549,953 | A | 8/1996 | Li | 428/64.1 |
| 5,571,624 | A | 11/1996 | Phillips et al. | 428/403 |
| 5,591,527 | A | 1/1997 | Lu | 428/411.1 |
| 5,613,022 | A | 3/1997 | Odhner et al. | 385/37 |
| 5,624,076 | A | 4/1997 | Miekka et al. | 241/3 |
| RE35,512 | E | 5/1997 | Nowak et al. | 101/454 |
| 5,627,663 | A | 5/1997 | Horan et al. | 359/2 |
| 5,629,068 | A | 5/1997 | Miekka et al. | 428/148 |
| 5,630,877 | A | 5/1997 | Kashiwagi et al. | 118/623 |
| 5,648,165 | A | 7/1997 | Phillips et al. | 428/346 |
| 5,650,248 | A | 7/1997 | Miekka et al. | 430/1 |
| 5,672,410 | A | 9/1997 | Miekka et al. | 428/148 |
| 5,700,550 | A | 12/1997 | Uyama et al. | 428/212 |
| 5,742,411 | A | 4/1998 | Walters | 359/2 |
| 5,744,223 | A | 4/1998 | Abersfelder et al. | 428/206 |
| 5,763,086 | A | 6/1998 | Schmid et al. | 428/404 |
| 5,811,775 | A | 9/1998 | Lee | 235/457 |
| 5,815,292 | A | 9/1998 | Walters | 359/2 |
| 5,838,466 | A | 11/1998 | Mallik | 359/2 |
| 5,856,048 | A | 1/1999 | Tahara et al. | 430/1 |
| 5,858,078 | A | 1/1999 | Andes et al. | 106/437 |
| 5,907,436 | A | 5/1999 | Perry et al. | 359/576 |
| 5,912,767 | A | 6/1999 | Lee | 359/567 |
| 5,981,040 | A | 11/1999 | Rich et al. | 428/209 |
| 5,989,626 | A | 11/1999 | Coombs et al. | 427/162 |
| 5,991,078 | A | 11/1999 | Yoshitake et al. | 359/567 |
| 6,013,370 | A | 1/2000 | Coulter et al. | 428/403 |
| 6,031,457 | A | 2/2000 | Bonkowski et al. | 340/572.1 |
| 6,033,782 | A | 3/2000 | Hubbard et al. | 428/407 |
| 6,043,936 | A | 3/2000 | Large | 359/572 |
| 6,045,230 | A | 4/2000 | Dreyer et al. | 359/529 |
| 6,068,691 | A | 5/2000 | Miekka et al. | 106/403 |
| 6,103,361 | A | 8/2000 | Batzar | |
| 6,112,388 | A | 9/2000 | Kimoto et al. | 29/17.3 |
| 6,114,018 | A | 9/2000 | Phillips et al. | 428/200 |
| 6,150,022 | A | 11/2000 | Coulter et al. | 428/403 |
| 6,157,489 | A | 12/2000 | Bradley, Jr. et al. | 359/584 |
| 6,160,046 | A | 12/2000 | Bleikolm et al. | 524/284 |
| 6,168,100 | B1 | 1/2001 | Kato et al. | 241/1 |
| 6,241,858 | B1 | 6/2001 | Phillips et al. | 204/192.15 |
| 6,242,510 | B1 | 6/2001 | Killey | 523/204 |
| 6,243,204 | B1 | 6/2001 | Bradley, Jr. et al. | 359/585 |
| 6,403,169 | B1 | 6/2002 | Hardwick et al. | 427/548 |
| 6,549,131 | B1 | 4/2003 | Cote et al. | 340/572.1 |
| 6,586,098 | B1 | 7/2003 | Coulter et al. | 428/403 |
| 6,589,331 | B2 | 7/2003 | Ostertag et al. | 106/460 |
| 6,643,001 | B1 | 11/2003 | Faris | 356/37 |
| 6,649,256 | B1 | 11/2003 | Buczek et al. | 428/323 |
| 6,686,027 | B1 | 2/2004 | Caporaletti et al. | 428/195.1 |
| 6,692,031 | B2 | 2/2004 | McGrew | 283/93 |
| 6,692,830 | B2 | 2/2004 | Argoitia et al. | 428/403 |
| 6,712,399 | B1 | 3/2004 | Drinkwater et al. | 283/111 |
| 6,729,656 | B2 | 5/2004 | Kubert et al. | 283/100 |
| 6,749,777 | B2 | 6/2004 | Argoitia et al. | 252/582 |
| 6,749,936 | B2 | 6/2004 | Argoitia et al. | 428/402 |
| 6,751,022 | B2 | 6/2004 | Phillips | 359/577 |
| 6,759,097 | B2 | 7/2004 | Phillips et al. | 427/510 |
| 6,761,959 | B1 | 7/2004 | Bonkowski et al. | 428/156 |
| 6,808,806 | B2 | 10/2004 | Phillips | |
| 6,815,065 | B2 | 11/2004 | Argoitia et al. | 428/403 |
| 6,818,299 | B2 | 11/2004 | Phillips et al. | 428/403 |
| 6,838,166 | B2 | 1/2005 | Phillips et al. | 428/323 |
| 6,841,238 | B2 | 1/2005 | Argoitia et al. | 428/323 |
| 6,901,043 | B2 | 5/2005 | Zhang et al. | 369/275.5 |
| 6,902,807 | B1 | 6/2005 | Argoitia et al. | 428/403 |
| 6,987,590 | B2 | 1/2006 | Phillips et al. | 359/614 |
| 7,029,525 | B1 | 4/2006 | Mehta | 106/31.6 |
| 7,047,883 | B2 | 5/2006 | Raksha et al. | 101/489 |
| 7,172,795 | B2 * | 2/2007 | Lambertini et al. | 427/510 |
| 7,258,900 | B2 * | 8/2007 | Raksha et al. | 427/548 |
| 7,300,695 | B2 * | 11/2007 | Argoitia et al. | 428/206 |
| 7,517,578 | B2 * | 4/2009 | Raksha et al. | 428/195.1 |
| 2002/0182383 | A1 | 12/2002 | Phillips | 428/199 |

| | | | | |
|---|---|---|---|---|
| 2003/0058491 | A1 | 3/2003 | Holmes et al. | 359/2 |
| 2003/0087070 | A1 | 5/2003 | Souparis | 283/91 |
| 2003/0134939 | A1 | 7/2003 | Vuarnoz et al. | 523/160 |
| 2003/0190473 | A1 | 10/2003 | Argoitia et al. | 428/403 |
| 2004/0009309 | A1 | 1/2004 | Raksha et al. | 427/598 |
| 2004/0028905 | A1 | 2/2004 | Phillips et al. | 428/404 |
| 2004/0051297 | A1 | 3/2004 | Raksha | |
| 2004/0081807 | A1 | 4/2004 | Bonkowski et al. | 428/195.1 |
| 2004/0094850 | A1 | 5/2004 | Bonkowski et al. | 264/1.34 |
| 2004/0100707 | A1 | 5/2004 | Kay et al. | 359/883 |
| 2004/0101676 | A1 | 5/2004 | Phillips | 428/323 |
| 2004/0105963 | A1 | 6/2004 | Bonkowski et al. | 428/195.1 |
| 2004/0151827 | A1 | 8/2004 | Argoitia et al. | 427/7 |
| 2004/0166308 | A1 | 8/2004 | Raksha et al. | 428/329 |
| 2005/0037192 | A1 | 2/2005 | Argoitia et al. | 428/323 |
| 2005/0063067 | A1 | 3/2005 | Phillips et al. | 359/623 |
| 2005/0106367 | A1 | 5/2005 | Raksha | |
| 2005/0123755 | A1 | 6/2005 | Argoitia et al. | 428/402 |
| 2005/0128543 | A1 | 6/2005 | Phillips et al. | 359/15 |
| 2005/0133584 | A1 | 6/2005 | Finnerty et al. | 235/375 |
| 2005/0189060 | A1 | 9/2005 | Huang et al. | 156/99 |
| 2006/0035080 | A1 | 2/2006 | Argoitia | 428/402 |
| 2006/0077496 | A1 | 4/2006 | Argoitia | 359/2 |
| 2006/0081151 | A1 | 4/2006 | Raksha et al. | 106/31.92 |
| 2006/0097515 | A1 | 5/2006 | Raksha et al. | 283/91 |
| 2006/0194040 | A1 | 8/2006 | Raksha et al. | 428/323 |
| 2006/0198998 | A1 | 9/2006 | Raksha et al. | 428/323 |
| 2006/0263539 | A1 | 11/2006 | Argoitia | 427/547 |
| 2007/0058227 | A1 | 3/2007 | Raksha et al. | 359/2 |

FOREIGN PATENT DOCUMENTS

| | | | |
|---|---|---|---|
| DE | 1696245 | | 1/1972 |
| DE | 3932505 | | 4/1991 |
| DE | 4212290 | | 5/1993 |
| DE | 4343387 | | 6/1995 |
| DE | 19611383 | | 9/1997 |
| DE | 19731968 | | 1/1999 |
| DE | 19744953 | | 4/1999 |
| DE | 19639165 | | 10/2003 |
| EP | 0138194 | | 10/1984 |
| EP | 0185396 | | 12/1985 |
| EP | 0341002 | | 11/1989 |
| EP | 0420261 | | 4/1991 |
| EP | 0453131 | | 10/1991 |
| EP | 0556449 | | 8/1993 |
| EP | 0406667 | | 1/1995 |
| EP | 0660262 | | 1/1995 |
| EP | 0170439 | | 4/1995 |
| EP | 0710508 | | 5/1996 |
| EP | 0756945 | | 2/1997 |
| EP | 0395410 | | 8/1997 |
| EP | 0698256 | | 10/1997 |
| EP | 0741370 | | 5/1998 |
| EP | 0914261 | | 5/1999 |
| EP | 0953937 | | 11/1999 |
| EP | 0 978 373 | A2 | 2/2000 |
| EP | 1174278 | | 1/2002 |
| EP | 1239307 | | 9/2002 |
| EP | 1 353 197 | | 10/2003 |
| EP | 1 498 545 | A | 1/2005 |
| EP | 1516957 | | 3/2005 |
| EP | 1529653 | | 5/2005 |
| EP | 166213 | | 6/2006 |
| EP | 1674282 | | 6/2006 |
| EP | 1719636 | | 11/2006 |
| EP | 1 741 757 | | 1/2007 |
| EP | 1745940 | | 1/2007 |
| EP | 1760118 | | 3/2007 |
| GB | 1107395 | | 3/1968 |
| GB | 1131038 | | 10/1968 |
| JP | 63172779 | | 7/1988 |
| JP | 11010771 | | 1/1999 |
| WO | WO88/07214 | | 9/1988 |
| WO | 93/23251 | | 11/1993 |
| WO | 95/17475 | | 1/1995 |
| WO | WO 95/13569 | | 5/1995 |
| WO | 97/19820 | | 6/1997 |
| WO | 98/12583 | | 3/1998 |
| WO | WO 00/08596 | | 2/2000 |
| WO | WO 01/03945 | | 1/2001 |
| WO | 02/00446 | | 1/2002 |
| WO | 02/04234 | | 1/2002 |
| WO | WO 02/40599 | | 5/2002 |
| WO | WO02/40600 | | 5/2002 |
| WO | WO 02/053677 | | 7/2002 |
| WO | WO 02/090002 | | 11/2002 |
| WO | WO 03/011980 | | 2/2003 |
| WO | WO 03/102084 | | 12/2003 |
| WO | WO2004/007096 | | 1/2004 |
| WO | 2004/024836 | | 3/2004 |
| WO | 2005/017048 | | 2/2005 |
| WO | WO 2005/017048 | | 2/2005 |

OTHER PUBLICATIONS

"Paper Based Document Security—a Review" Rudolf L. van Renesse, European Conference on Security and Detection, Apr. 28-30, 1997, Conference Publication No. 437, pp. 75-80.

Diffractive Microstructures for Security Applications: M. T. Gale, Paul Scherrer Institute, Zurich, IEEE Conference Publication London 1991, pp. 205-209, Sep. 16-18, 1991.

Definition of "directly" from Webster's Third New International Dictionary, 1993, p. 641.

John M. McKiernan et al; "Luminescence and Laser Action of Coumarin Dyes Doped in Silicate and Aluminosilicate Glasses Prepared by Sol-Gel Technique," Journal of Inorganic and Organometallic Polymers, vol. 1, No. 1, 1991, pp. 87-103.

Jeffrey I. Zink et al, "Optical Probes and Properties of Aluminosilicate Glasses Prepared by the Sol-Gel Method," Polym. Mater. Sci. Eng., pp. 204-208 (1989).

"Security Enhancement of Holograms with Interference Coatings" by Phillips et al. Optical Security and Counterfeit Deterrence Techniques III Proceedings of SPIE vol. 3973 pp. 304-316 (2000).

Don W. Tomkins, Kurz Hastings, "Transparent Overlays for Security Printing and Plastic ID Cards" pp. 1-8, Nov. 1997.

J.A. Dobrowolski et al, "Optical Interference Coatings for Inhibiting of Counterfeiting" Optica Acta, 1973, vol. 20, No. 12, 925-037.

Frans Defilet, LGZ Landis & Gyr Zug Corporation, "Kinegrams 'Optical Variable Devices' (OVD's) for Banknotes, Security Documents and Plastic Cards" San Diego, Apr. 1-3, 1987.

S.P. McGrew, "Hologram Counterfeiting: Problems and Solutions" SPIE, vol. 1210 Optical Security and Anticounterfeiting Systems, 1990, pp. 66-76.

Rudolf L. van Renesse, "Security Design Of Valuable Documents And Products" SPIE, vol. 2659, Jun. 1996, pp. 10-20.

Steve McGrew, "Countermeasures Against Hologram Counterfeiting" Internet site www.iea.com/nli/publications/countermeasures.htm, Jan. 6, 2000.

Roger W. Phillips, "Optically Variable Films, Pigments, and Inks" SPIE vol. 1323 Optical Thin Films III: New Developments, 1990, pp. 98-109.

Roger W. Phillips et al. "Optical Coatings for Document Security" Applied Optics, vol. 35, No. 28, Oct. 1, 1996 pp. 5529-5534.

J. Rolfe "Optically Variable Devices for use on Bank Notes" SPIE, vol. 1210 Optical Security and Anticounterfeiting Systems, pp. 14-19, 1990.

OVD Kinegram Cor "OVD Kinegram Management of Light to Provide Security" Internet site www.kiknegram.com.xhome.html, Dec. 17, 1999.

I.M. Boswarva et al., "Roll Coater System for the Production of Optically Variable Devices (OVD's) for Security Applications" Proceedings, 33rd Annual technical Conference, Society of Vacuum Coaters, pp. 103-109 (1990).

Trub AG Switzerland, Security and Design Absolute Identity Latent Filter Image: LFI®, 2007, Trub AG, Hintere Bahnhofstrasse 12, CH-5001, Aarau http://www.trueb.ch/generator.aspx?tabindex=3&tabid=105&palias=en.
Himpsel et al, "Nanowires by Step Decoration", Mat. Research Soc. Bul., p. 20-24 (Aug. 1999).
Llewellyn, "Dovids: Functional Beauty—discussion about holography", Paper, Film, and Foil Converter, Aug. 2002.
Hardin, "Optical tricks designed to foil counterfeiters" OE Reports, No. 191, Nov. 1999.
Coombs et al, "Integration of contracting technologies into advanced optical security devices", SPIE Conference on Document Security, Jan. 2004.
R. Domnick et al, "Influence of Nanosized Metal Clusters on the Generation of Strong Colors and Controlling of their Properties through Physical Vapor Deposition (PVD)" 49$^{th}$ Annual Technical Conference Proceedings (2006), Society of vacuum Coasters.
Dobrowolski et al., "Research on Thin Film Anticounterfeiting Coatings at the National Research Council of Canada", Applied Optics, vol. 28, No. 14, pp. 2702-2717 (Jul. 15,1989).
Powell et al, (ED.), Vapor Deposition, John Wiley & Sons, p. 132 (1996).
Van Renesse (Ed.), Optical Document Security, 2$^{nd}$ Ed., Artech House, 254,349-69 (1997).
Prokes et al (Ed.), Novel Methods of Nanoscale Wire Formation, Mat. Research Soc. Bul., pp. 13-14 (Aug. 1999).
Lotz et al., Optical Layers on Large Area Plastic Films, Precision, Applied Films (Nov. 2001).
Halliday et al, "Fundamentals of Physics, Sixth Edition", p. 662, Jul. 2000.
Argoitia et al, "Pigments Exhibiting Diffractive Effects", Soc. of Vac. Coaters, 45$^{th}$ Annual Tech. Conf. Proceed. (2002).
Argoitia et al, "The concept of printable holograms through the alignment of diffractive pigments", SPIE Conference on Document Security, Jan. 2004.
Argoitia and Witzman, Pigments Exhibiting Diffractive Effects, Soc. Of Vac. Coaters, 45$^{th}$ Annual Tech. Conf. Proceed. (2002).
Alberto Argoitia, "Pigments Exhibiting a Combination of Thin Film and Diffractive Light Interference". AIMCAL Fall Technical Conference, 16$^{th}$ International Vacuum Web Coating Conference, 2002, pp. 1-9.

* cited by examiner

Fig. 1
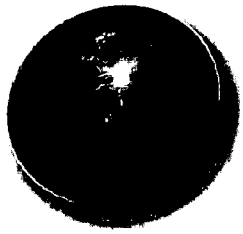
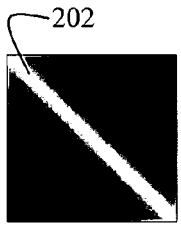
Fig. 2a
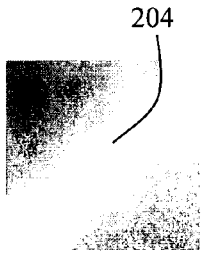
Fig. 2b
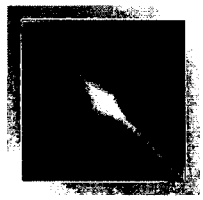
Fig. 2c
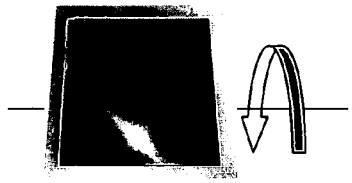
Fig. 2d

TWO-STEP METHOD OF COATING AN ARTICLE FOR SECURITY PRINTING BY APPLICATION OF ELECTRIC OR MAGNETIC FIELD

CROSS-REFERENCE TO RELATED APPLICATIONS

This application is a continuation-in-part of U.S. patent application Ser. No. 11/028,819 filed Jan. 4, 2005, now issued as U.S. Pat. No. 7,300,695, which is a divisional of U.S. patent application Ser. No. 10/243,111 filed Sep. 13, 2002, now U.S. Pat. No. 6,902,807 of Jun. 7, 2005, which are incorporated herein by reference for all purposes.

This invention claims priority from US Provisional patent application No. 60/700,994 filed Jul. 20, 2005, which is incorporated herein by reference for all purposes.

This application is related to U.S. patent application Ser. No. 10/029,405, filed Dec. 20, 2001, now issued as U.S. Pat. No. 6,749,936 of Jun. 15, 2004; U.S. Ser. No. 09/919,346, filed Jul. 31, 2001, now issued as U.S. Pat. No. 6,692,830 of Feb. 17, 2004; and U.S. Ser. No. 10/117,307 filed Apr. 5, 2002, now issued as U.S. Pat. No. 6,841,238 of Jan. 11, 2005, which are incorporated herein by reference for all purposes.

FIELD OF THE INVENTION

This invention relates generally to a two-step method of making a security printed image and more particularly, to a method of forming the image by coating of the surface of the substrate with an ink containing alignable flaked material and exposing the coated surface to a magnetic or electric field so as to align at least some of the flaked material, and subsequently re-coating the substrate with a second printed image over or under of the first image.

BACKGROUND OF THE INVENTION

This invention relates to the coating of a substrate with an ink or paint or other similar medium to form an image exhibiting optically-illusive effects. Many surfaces painted or printed with flat platelet-like particles show higher reflectance and brighter colors than surfaces coated with a paint or ink containing conventional pigments. Substrates painted or printed with color-shifting flaked pigments show change of color when viewed at different angles. Flaked pigments may contain a material that is magnetically sensitive, so as to be alignable or orientable in an applied magnetic field. Such particles can be manufactured from a combination of magnetic and non-magnetic materials and mixed with a paint or ink vehicle in the production of magnetic paints or inks. A feature of these products is the ability of the flakes to become oriented along the lines of an applied field inside of the layer of liquid paint or ink while substantially remaining in this position after drying or curing of the paint or ink vehicle. Relative orientation of the flake and its major dimension in respect to the coated surface determines the level of reflectance or its direction and, or may determine the chroma of the paint or ink. Alternatively, dielectric material may be alignable in an electric field.

Alignment of magnetic particles along lines of applied magnetic field has been known for centuries and is described in basic physics textbooks. Such a description is found in a book by Halliday, Resnick, Walker, entitled, Fundamentals of physics. Sixth Edition, p. 662. It is also known to align dielectric particles in an electric field, and this form alignment is applicable to this invention.

The patents hereafter referred to are incorporated herein by reference for all purposes.

U.S. Pat. No. 3,853,676 in the name of Graves et al. describes painting of a substrate with a film comprising film-forming material and magnetically orientable pigment that is oriented in curved configurations and located in close proximity to the film, and that can be seen by the naked eye to provide awareness to the viewer of the location of the film.

U.S. Pat. No. 5,079,058 by Tomiyama discloses a patterned film forming a laminated sheet comprising a multi-layer construction prepared by successively laminating a release sheet layer, a pressure-sensitive adhesive layer, a base sheet layer, and a patterned film layer, or further laminating a pigmented print layer. The patterned film layer is prepared by a process which comprises coating a fluid coating composition containing a powdery magnetic material on one side of the base sheet layer to form a fluid film, and acting a magnetic force on the powdery magnetic material contained in the fluid film, in a fluid state, to form a pattern.

U.S. Pat. No. 5,364,689 in the name of Kashiwagi discloses a method and an apparatus for producing of a product having a magnetically formed pattern. The magnetically formed pattern becomes visible on the surface of the painted product as the light rays incident on the paint layer are reflected or absorbed differently by magnetic particles arranged in a shape corresponding to desired pattern. More particularly, Kashiwagi describes how various patterns, caused by magnetic alignment of nickel flakes, can be formed on the surface of a wheel cover.

U.S. Pat. No. 6,808,806 by Phillips in the name of Flex Products Inc., discloses methods and devices for producing images on coated articles. The methods generally include applying a layer of magnetizable pigment coating in liquid form on a substrate, with the magnetizable pigment coating containing a plurality of magnetic non-spherical particles or flakes. A magnetic field is subsequently applied to selected regions of the pigment coating while the coating is in liquid form, with the magnetic field altering the orientation of selected magnetic particles or flakes. Finally, the pigment coating is solidified, affixing the reoriented particles or flakes in a non-parallel position to the surface of the pigment coating to produce an image such as a three dimensional-like image on the surface of the coating. The pigment coating can contain various interference or non-interference magnetic particles or flakes, such as magnetic color shifting pigments.

U.S. Pat. No. 6,103,361 reveals patterned substrates useful in producing decorative cookware formed by coating a base with a mixture of fluoropolymer and magnetic flakes that magnetically induce an image in the polymer coating composition. The baked fluoropolymer release coating contains magnetizable flakes. A portion of the flakes are oriented in the plane of the substrate and a portion of said flakes are magnetically reoriented to form a pattern in the coating which is observed in reflected light, the flakes having a longest dimension which is greater than the thickness of said coating. The patterned substrate is formed by applying magnetic force through the edges of a magnetizable die positioned under a coated base to induce an imaging effect or pattern.

A common feature of the above-mentioned prior art references is a formation of different kinds of patterns in a painted or printed layer. Most of the patterns exist as indicia such as symbols, shapes, signs, or letters; and these patterns replicate the shape of a magnet often located beneath the substrate and are formed by shadowing contour lines appearing in the layer of paint or ink resulting in particular alignments of magnetic flakes. The desired pattern becomes visible on the surface of the painted product as the light rays incident on the paint layer are reflected or absorbed differently by the subgroup of magnetic non-spherical particles.

Although these prior art references provide some useful and interesting optical effects, there is a need for patterns which have a greater degree of optical illusivity, and which are more difficult to counterfeit. United States patent application number 20050106367, filed Dec. 22, 2004 in the name of Raksha et al. entitled Method and Apparatus for Orienting Magnetic Flakes describes several interesting embodiments which provide optical illusivity, such as a "rolling-bar" and a "flip-flop" which may serve as the basis of embodiments of this invention. Notwithstanding, there is need to provide different patterns on a single substrate wherein two coatings yield images that appear to move independently of one another as the direction of light changes or as the image is rotated or tilted.

It is an object of this invention to provide a more complex image having at least two distinct features wherein each feature is embodied in a separately applied coating.

It is an object of this invention to provide a more complex image having at least two distinct features wherein each feature is embodied in a separate coating and wherein the at least two coatings provide the appearance of two images moving synergistically together yet appearing distinct form one another as the image is moved in one direction.

STATEMENT OF THE INVENTION

In accordance with an aspect of the invention there is provided, a method of coating an article comprising the steps of:

applying a first magnetic coating to a substrate using a magnetic field to orient flakes within the coating along magnetic field lines; and, after the first coating has cured, subsequently applying a second magnetic coating over the first coating and using a magnetic field to orient flakes within the second coating along magnetic field lines.

In accordance with an aspect of the invention there is further provided, a method of coating an article comprising the steps of:

applying a first magnetic coating to a substrate;

using a magnetic field to orient flakes within the coating in dependence upon the direction of the magnetic field lines; and, after the first coating has cured, subsequently applying a second magnetic coating over the first coating and using a second magnetic field to orienting flakes within the second coating in dependence upon the second magnetic field; and allowing the second magnetic coating to cure.

In accordance with another aspect of the invention there is provided an image formed of magnetic particles aligned by a magnetic field, wherein two distinct features within the image appear to move simultaneously, and wherein the movement is relative movement, when the image is moved or when the light source upon the image is moved.

In accordance with another aspect of the invention there is provided an image formed of magnetic particles wherein two distinct features within the image appear to move, wherein one is stationary while the other moves, and vice versa, when the image is moved in two different directions or when the light source upon the image is moved in two different directions.

In a broad aspect of this invention, a method of providing an optically illusive image is provided comprising the steps of applying a pigment having magnetically alignable flakes therein over or under an already formed image, and magnetically aligning the magnetically alignable flakes within the pigment and allowing the flakes to cure.

It should be understood, from the above broad aspects of this invention that preferably magnetically alignable flakes are used, and a magnetic field is provided to align the magnetically alignable flakes; notwithstanding, other forces are fields that can align a plurality of flakes at a same time, in a predetermined orientation, are also within the scope of this application.

More broadly stated, this invention provides a method of forming an image by applying a first optical effect coating to a first side of the substrate and using a magnetic or electric field to orient flakes within the coating independence upon the field; and, applying a second optical effect coating over the first coating or over the second side of the substrate, wherein effects of both coatings, or combined effects can be seen from at least one side of the substrate.

In an alternative embodiment of the invention first and second coatings include diffractive flakes, having a surface relief pattern formed therein or thereon, and flakes in the first coating are oriented along their surface relief pattern in a different orientation than diffractive flakes in the second coating.

BRIEF DESCRIPTION OF THE DRAWINGS

Exemplary embodiments of the invention will now be described in accordance with the drawings in which:

FIG. 1 is a drawing of a gemstone exhibiting aasterism caused by small needles of rutile (titanium oxide) exhibiting six rays.

FIGS. 2*a* through 2*d* depict the steps in the manufacture of an image having two crossed rolling bars that appear to move with a change of viewing angle.

DETAILED DESCRIPTION

Figure 3A:
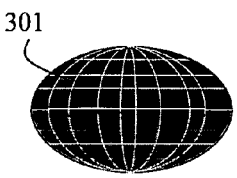
FIGS. 3*a* through 3*d* show a series of steps and images which form a final image in FIG. 3*d* wherein a globe having text therein provides a flip-flop optical effect.

Orienting of magnetic flakes dispersed in a paint or an ink vehicle along lines of an applied magnetic field may produce a plurality of illusive optical effects. Many of these effects, described in other patents and patent applications assigned to Flex Products Inc., have dynamic animation-like appearance similar to holographic kinograms or a tiger eye effect in gemstones. When a graphic image, printed on the surface of a substrate in the presence of a magnetic field, is tilted or bent with respect to the light source and to the viewer, the illusive optical effect moves toward or out of the viewer, or to the left or to the right.

However, in accordance with this invention it is possible to fabricate very different and more complex kinds of optical effects with two-stage printing or painting of an article with magnetic ink or paint containing magnetic particles, in the presence of different magnetic fields. In the first stage the clear or dyed ink or paint vehicle, mixed with reflecting or color-shifting of diffractive or any other platelet-like magnetic pigment of one concentration (preferably 15-50 weight %), is printed/painted on the surface of an article in any predetermined graphical pattern, exposed to the magnetic field to form a predetermined optical effect, and cured to fix magnetic flakes in the layer of solid ink/paint vehicle. In the second stage the ink or paint of lower concentration (preferably in the range of 0.1-15 wt. %) is printed on the top of the first printed image, exposed to the magnetic field, and cured. The ink or paint vehicle for the second layer is preferably clear, however may be dyed. Magnetic pigments for the second printed/painted layer can be the same as for the first layer or may be different. The pigment size for the second layer can be the same or different. The color of the pigment for the second layer can be the same as for the first layer or different. The shape and intensity of the field, applied to the second layer, can be the same or preferably may be different so that the viewer experiences two different effects. The graphical pattern for the second layer can be the same or different. Combination of inks or pigments colors may either enhance or depress a particular color in the final printed image.

Complex patterns of lines, points, arcs, and other shapes, enhanced with optically-illusive effects of current invention, can be utilized in printing process to make visually encrypted documents difficult for counterfeiters to reproduce.

The substrate for the two-step printing in accordance with this invention can be transparent or opaque; this is generally determined by the graphics of the image and the desired optical effect. In the instance where an opaque substrate is utilized, the first and second applied coating layers are printed or painted on a same side of the opaque substrate with the more transparent image applied as the second coating over top of the first coating layer. For transparent substrates the application for the first and second coatings can be as described for opaque substrates, or alternatively and preferably, the first coating layer can be printed with a concentrated ink on a first side of the substrate and the second coating layer can be printed with diluted ink on opposite side of the substrate. For some purposes, the first coating layer can be a printed layer with diluted ink and the layer with concentrated ink can be printed second. Observation of a final image can be done through the substrate.

A first example of a printed article in accordance with an embodiment of this invention, with two crossing rolling bars produces an optical effect similar to asterism. United States patent application numbers 2004/0051297, and 2005/0106367 in the name of Raksha et al, describe a single rolling bar and a method for making a rolling bar, wherein the effect is formed by a cylindrical convex or concave reflection of light rays from magnetic particles dispersed in the ink or paint vehicle and aligned in the magnetic field.

Asterism in gemstones is caused by dense inclusions of tiny, parallel, slender fibers in the mineral which cause the light to reflect a billowy, star-like formation of concentrated light which moves around when the mineral is rotated. This is usually caused by small needles of rutile (titanium oxide) in the case of ruby and sapphire as exemplified in FIG. 1. The stars may exhibit four, six, or more rays.

A flexographic printed image of a box with a four-ray star, or two rolling bars, is shown in FIGS. 2*c* and 2*d*. The image in FIG. 2*a* of a single rolling bar 202 is printed in a first step with ink containing 25 wt. % of a green to gold color-shifting pigment on the surface of clear, translucent or opaque substrate and the convex rolling bar 202 is formed in applied magnetic field.

The second image shown in FIG. 2*b* is printed with an ink containing 10 wt. % of the same green to gold pigment dispersed in a clear ink vehicle (that makes it translucent) on the top of the first image 202 and the convex rolling bar 204 is formed in the field where its direction is at 90° to the direction of the rolling bar 202 in the first printed image of FIG. 2*a*. The resulting printed image of FIG. 2*c* shows four rays star. The star moves to the bottom of the printed image shown in FIG. 2*d*, when it is rotated or tilted horizontally with its upper edge away from the viewer, or up to the top of the image if it was tilted toward the viewer. By tilting the image back and forth in the direction shown in FIG. 2*d*, both rolling bars appear to simultaneously move toward and away from each other. By coating the substrate with two rolling bars in this manner, the functionality of each rolling bar of giving the perception of rolling across the sheet as it is rotated, is provided so that both bars appear to move synergistically, in apparently different directions by even a slight rotation in one direction. In this embodiment it is not necessary to move or tilt the sheet in two different directions to view both bars moving. A single movement in a single direction gives the perception of two bars moving differently.

Referring now to FIG. 3*a*, an image of a globe 301, shown was silkscreen printed with a thick 30 wt. % ink, containing magenta to gold color-shifting pigment with the particles averaged size of 22 microns, and exposed to magnetic field to form the V-shaped flip-flop optical effect. The flip-flop effect is described in U.S. patent applications 2004/0051297, and 2005/0106367, in the name of Raksha et al., incorporated herein by reference. In this effect the bottom half below the equator line of the globe has bright magenta color and the top side has dark gold color at normal angle of observation. Magnetic flakes in the bottom part of the image obtain such orientation in an applied magnetic field; these flakes send reflected light right into the eye of the observer, which makes them appear bright. In contrast, the particles in the upper part of the globe send reflected light in the direction of observer's chest. The color of the flakes at this observation angle and this particular particles orientation is gold. When the globe, printed on the substrate, is tilted with its upper edge out of the observer the flakes in the bottom part reflect the light rays in the direction of the observer's hat that makes them dark gold. Simultaneously, the flakes in the upper part of the globe reflect the rays of incident light into the eye of the observer that visible as bright magenta. Tilt of the sample in the opposite direction swaps the colors of the image back.

Figure 3B:
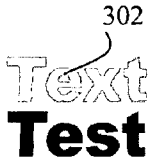
Figure 3C:
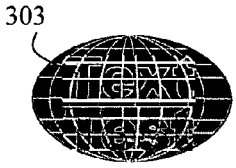
Figure 3D:
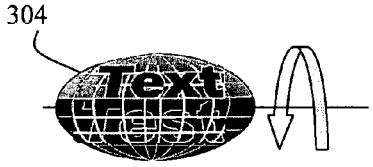

The second image 302 "Test Text" shown in FIG. 3*b* is printed with diluted 10 wt. % ink on the top of the globe 301 and exposed to another magnetic field that produces a roof-shaped orientation of magnetic particles. An optical effect in the image, printed with these oriented particles, has a color "swap" opposite to the color changes of the first printed image. The pigment in the second ink is the same magenta to gold as in the first image but its size is close to 10 microns. The hue of this pigment has the same value as the larger 22 micron pigment but its chroma is lower than the chroma of larger pigment of the first layer that makes it slightly darker. At a normal angle of observation, the resulting image 303 in FIG. 3*c* shows translucent light magenta "Text" on a dark gold background and dark gold translucent "Test" on a bright magenta globe background. When the print 303 is tilted with its upper edge away from the observer, as shown in 304, two parts of the globe and the text interchange or "swap" their colors. The upper part of the globe becomes bright magenta with translucent dark gold TEXT and the bottom part of the globe becomes dark gold with bright magenta TEST.

Figure 4A:
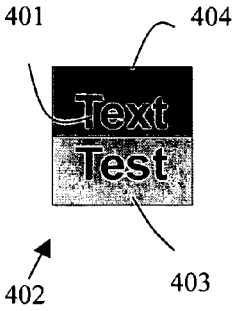
FIGS. 4*a* through 4*d* depict the steps in the manufacture of a flip-flop and a rolling bar created on a same substrate.
Figure 4B:
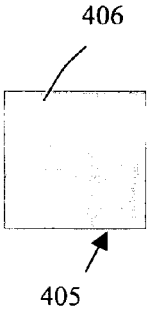
Figure 4C:
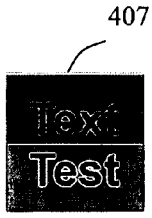
Figure 4D:
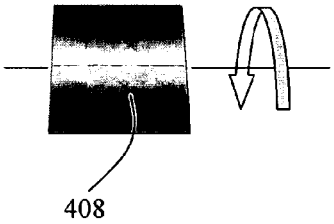

The "Text Test" logo 401, shown in FIG. 4*a*, was printed on the top of the image 402 containing a flip-flop feature described in the abovementioned patents. The image 402 was printed with a concentrated ink containing magnetic pigment Al/M/Al (where Al is aluminum, M is any magnetically alignable material). The flip flop can be formed with either V-shaped or roof-shaped alignment of magnetic flakes in the solid organic media. At normal angle of observation and the V-shape alignment of the particles in the resin, the bottom part 403 of the image 402 is bright and the top part 404 is dark. A second image 405 was printed on the top of the image 402. In FIG. 4*b* the image 405 was printed with diluted ink, containing 5 wt. % of gold magnetic non-shifting pigment, and placed in the field to form a rolling bar optical feature. The rolling bar 406 is formed near top of the image. The ink was cured after completion of the particles alignment. The flip flop and the text are highly visible through the layer of the top coat in the double-printed image 407 at in FIG. 4*d* at normal angle of observation.

However, at the tilt of the printed image with its upper edge away from the observer, the rolling bar rolls down the printed image 407 and takes a place in the middle 408 of the box hiding the logo 401 and the flip-flop as shown in FIG. 4*a*. An image 501, shown in FIG. 5*a*, was a flexoprinted on transparent substrate 500 with the ink containing 20 wt. % of magnetic pigment, placed in the field to form the convex rolling bar optical effect 502 and cured to fix aligned magnetic particles. Flexo printing or flexographic printing is a machine printing process that utilizes rollers or cylinders with a flexible rubber-like surface that prints with the raised area, much like surface printing, but with much less ink. In this process the ink dries quickly and allows the machine to run at high speed. The finished product has a very smooth finish with crisp detail and often resembles rotary screen printing.

Figures 5A, 5B, 5C, 5D:
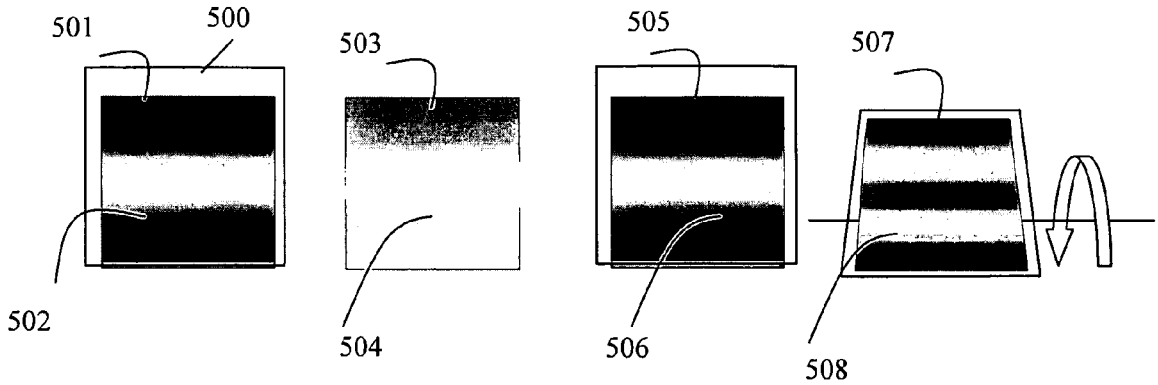
FIGS. 5*a* through 5*d* illustrate the steps in several images of printing two rolling bars which appear to move closer together to form a single rolling bar and which upon tilting the image appear to separate into two rolling bars.

In FIG. 5*b* another image 503 is printed with diluted ink, placed in the field to form the concave rolling bar 504 and cured to fix the particles in this position. The final print 505 shows at normal angle of observation an image with the single rolling bar effect 506. When the sample is tilted with its upper edge away from the observer the single rolling bar 506 splits in two rolling bars 507 and 508 moving in opposite direction. Reversed tilt of the image to the normal angle brings the rolling bars 507 and 508 together to make a single optical effect. Both printed images may have the same shape, as shown in FIG. 5*d*, or may have different shapes.

Figures 6A, 6B:
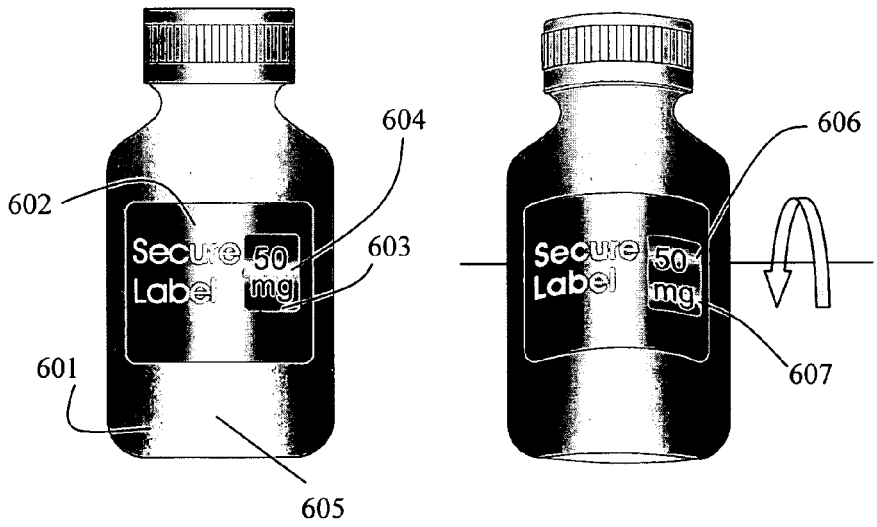
FIGS. 6*a* and 6*b* illustrate a container with the feature of the rolling bar of FIG. 5*d*.

Referring now to FIGS. 6*a* and 6*b* a very attractive image for making of security labels on curved surfaces is shown. Pharmaceutical packaging bottles, shown in FIG. 6*a* and 6*b*, are a good example of utilization of splitting rolling bars. The bottle 601 has a label 602 adhered to its surface. Security feature 603 with splitting rolling bar described in the previous example is printed on the top of the label 602. The feature 603 has a single rolling bar 604 at normal angle of observation. The bottle has a wide line 605 created by reflection of incident light from cylindrical surface of the bottle. However, the rolling bar 604, which also looks like a reflecting cylindrical surface, is at 90° to the line 605. Tilt of the bottle 601 with its top away from the observer causes a split of the rolling bar 604 in two rolling bars 606 and 607. When the bottle is tilted back, the rolling bars 606 and 607 collapse in the single rolling bar 604 again.

Figure 7A:
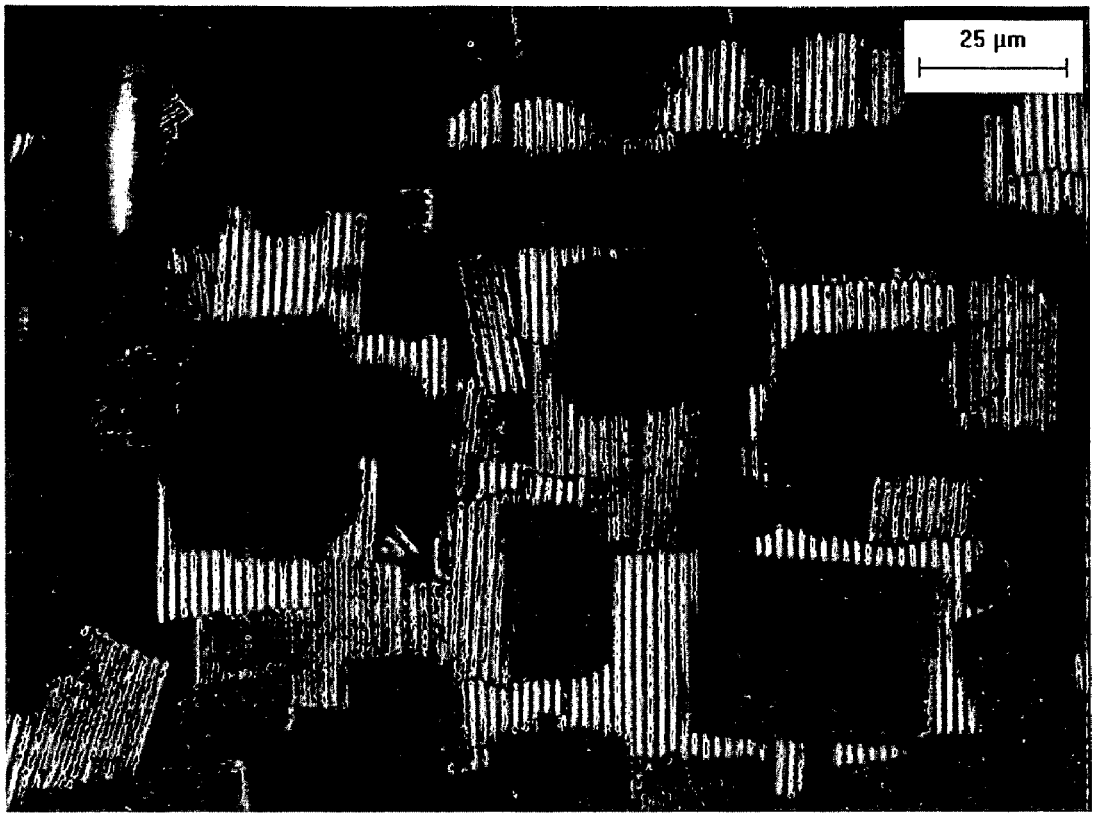
FIGS. 7*a* and 7*b* micrographs showing an area of an image obtained with a two steps printing process, wherein the two micrographs correspond to the same area of the image.
Figure 7B:
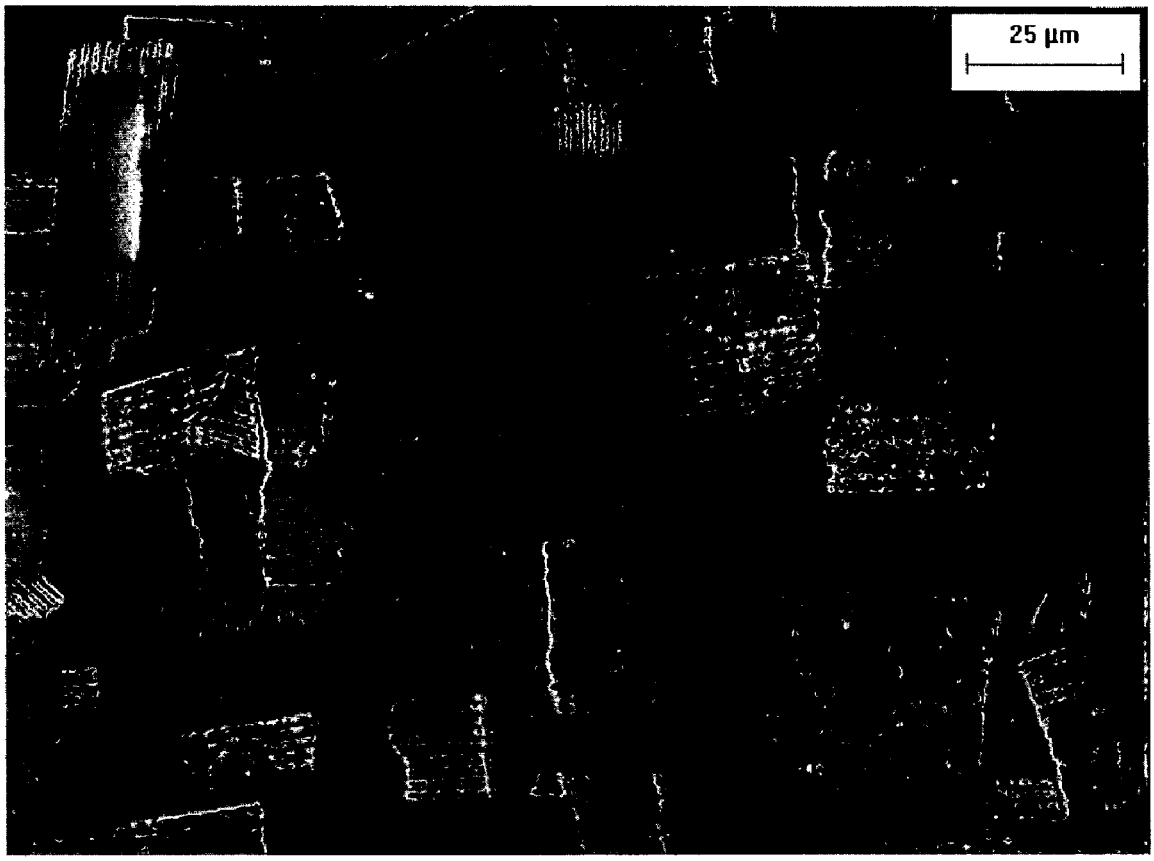

Turning now to FIGS. 7*a* and 7*b*, micrograph 7*a* shows the groove orientation of the pigments of a first applied layer of diffractive particles in a carrier using a magnetic filed oriented up-down (or vice versa). After the first printed layer was cured, a second print on top of the first was applied with a magnetic field oriented left to right (or vice versa). The camera used to capture the micrograph in FIG. 7*b* was focused to show the second groove orientation of the micro-structured particles. Notice that the loading of the second coating is lower that the loading of the first.

It should also be understood that in the subsequent figures and embodiments shown, groove oriented flakes can be used in place or along with the other types of flakes describe heretofore.

Although the embodiments described heretofore, depict the two-step application of coatings to a same or different side of a substrate, less preferably, but still within the scope of this invention, is the use a first alignable flake coating on a first substrate, laminated to a second substrate having a similar or different printed image or etched image thereon. For example in a first step a rolling bar can be printed on a first substrate, which can subsequently be laminated to a holographic image, wherein one of the substrates is substantially light transmissive.

In another less preferred embodiment of this invention two coatings are applied to different sides of a substrate, wherein a second of the coatings has a viscosity which changes when energy such as light of a predetermined wavelength is applied and the coating become fluid; The first coating is a standard coating which can be magnetized and aligned after being applied. After the first coating cures and the flakes are permanently aligned, the second coating can be made fluid enough to align the flakes, and subsequently cured.

Of course numerous other embodiments of the invention may be envisaged, without departing from the spirit and scope of the invention.

What we claim is:

1. A method of coating an article comprising the steps of:

applying a first field orientable coating comprising flakes in an ink or paint vehicle to a first side of a substrate and using a first magnetic or electric field to orient the flakes within the first coating along field lines;

after the flakes within the first coating have been aligned, curing the first coating; and, after the first coating has cured, subsequently applying a second magnetic coating over the first coating or over the second side of the substrate under the first coating and using a second magnetic or electric field to orient flakes within the second coating along field lines, wherein configurations of the first and second magnetic or electric fields are different from one another.

2. A method as defined in claim 1, wherein the magnetic field for orienting the flakes within the first coating is a first magnetic field and wherein the magnetic field used to orient flakes within the second coating is a second magnetic field.

3. A method as defined in claim 1, wherein the magnetic or electric fields are generated by different field generating systems.

4. A method as defined in claim 1 wherein a concentration of flakes in the first coating is different from a concentration of flakes in the second coating.

5. A method as defined in claim 4, wherein one of the first and second coatings includes multilayer optically variable flakes and wherein the other of the coatings includes diffractive flakes, wherein at least some of the diffractive flakes have a surface relief pattern formed therein.

6. A method as defined in claim 1, wherein the first and second coatings include diffractive flakes, having a surface relief pattern formed therein or thereon, and wherein flakes in the first coating are oriented along their surface relief pattern in a different orientation than diffractive flakes in the second coating.

7. A method as defined in claim 1, wherein the flakes within the second coating are oriented differently than the flakes of the first coating.

8. A method of creating an image comprising the steps of:

applying at a first coating over a first side of a substrate;

providing a first magnetic field to align particles within the first coating in a predetermined manner;

allowing the first coating to cure or dry; and, after the first coating has cured or dried, applying a second coating over the first coating or over a second side of the substrate under the first coating and, providing a second magnetic field before the second coating is cured or dried so as to align particles within the second coating, wherein configurations of the first and second magnetic or electric fields are different from one another.

9. A method of forming an image on a substrate comprising the steps of:

applying a first optical effect coating to a first side of the substrate and using a first magnetic or electric field to orient flakes within the coating in dependence upon the field; and, applying a second optical effect coating over the first coating or over the second side of the substrate under the first coating and using a second magnetic or electric field to orient flakes within the coating in dependence upon the field, wherein configurations of the first and second magnetic or electric fields are different from one another, and wherein effects of both coatings, or combined effects can be seen from at least one side of the substrate.

* * * * *